United States Patent [19]

Lindestrom et al.

[11] 3,935,880

[45] Feb. 3, 1976

[54] DEVICE FOR REDUCTION OF DISTURBING NOISE IN A FLOW CONTROL DEVICE

[75] Inventors: Lars-Erik E. Lindestrom, Kristinehamn; Arne S. Wibring, Jonkoping, both of Sweden

[73] Assignee: Aktiebolaget Svenska Flaktfabriken, Stockholm, Sweden

[22] Filed: Aug. 23, 1974

[21] Appl. No.: 499,994

[30] Foreign Application Priority Data

Aug. 24, 1973 Sweden ..... 7311572

[52] U.S. Cl. ..... 137/499

[51] Int. Cl.[2] ..... F24F 11/04

[58] Field of Search ..... 137/499, 520; 138/43; 98/95

[56] References Cited

UNITED STATES PATENTS

| | | | |
|---|---|---|---|
| 752,061 | 2/1904 | Gander | 137/499 |
| 2,116,912 | 5/1938 | Richardson | 137/499 X |
| 2,749,833 | 6/1956 | Hekelaar | 137/499 X |

FOREIGN PATENTS OR APPLICATIONS

| | | | |
|---|---|---|---|
| 83,843 | 11/1957 | Denmark | 137/499 |
| 1,733 | 1862 | United Kingdom | 137/499 |
| 362,490 | 12/1973 | Sweden | 137/499 |

*Primary Examiner*—Martin P. Schwadron
*Assistant Examiner*—Robert J. Miller
*Attorney, Agent, or Firm*—Cushman, Darby & Cushman

[57] ABSTRACT

A flow control device in a casing through which air passes comprises a baffle or threshold projecting from one inner wall of the casing toward an opposed wall and having an arcuate surface facing upstream, a plate or pressure plane disposed upstream of the threshold and mounted for rotation such that its downstream end moves parallel to the arcuate face of the threshold; and a hollow body disposed transversely of the casing and carried by the downstream end of the pressure plane for movement therewith so that the body serves as a closure member for the space between the free edge of the threshold and the opposed wall of the casing, the body having a transverse edge facing upstream and dividing the air flow into two streams one of which flows to an adjustable gap between the body and the opposed wall of the casing and the other of which flows to a fixed gap located between the body and the pressure plane.

7 Claims, 2 Drawing Figures

DEVICE FOR REDUCTION OF DISTURBING NOISE IN A FLOW CONTROL DEVICE

Figure 1:
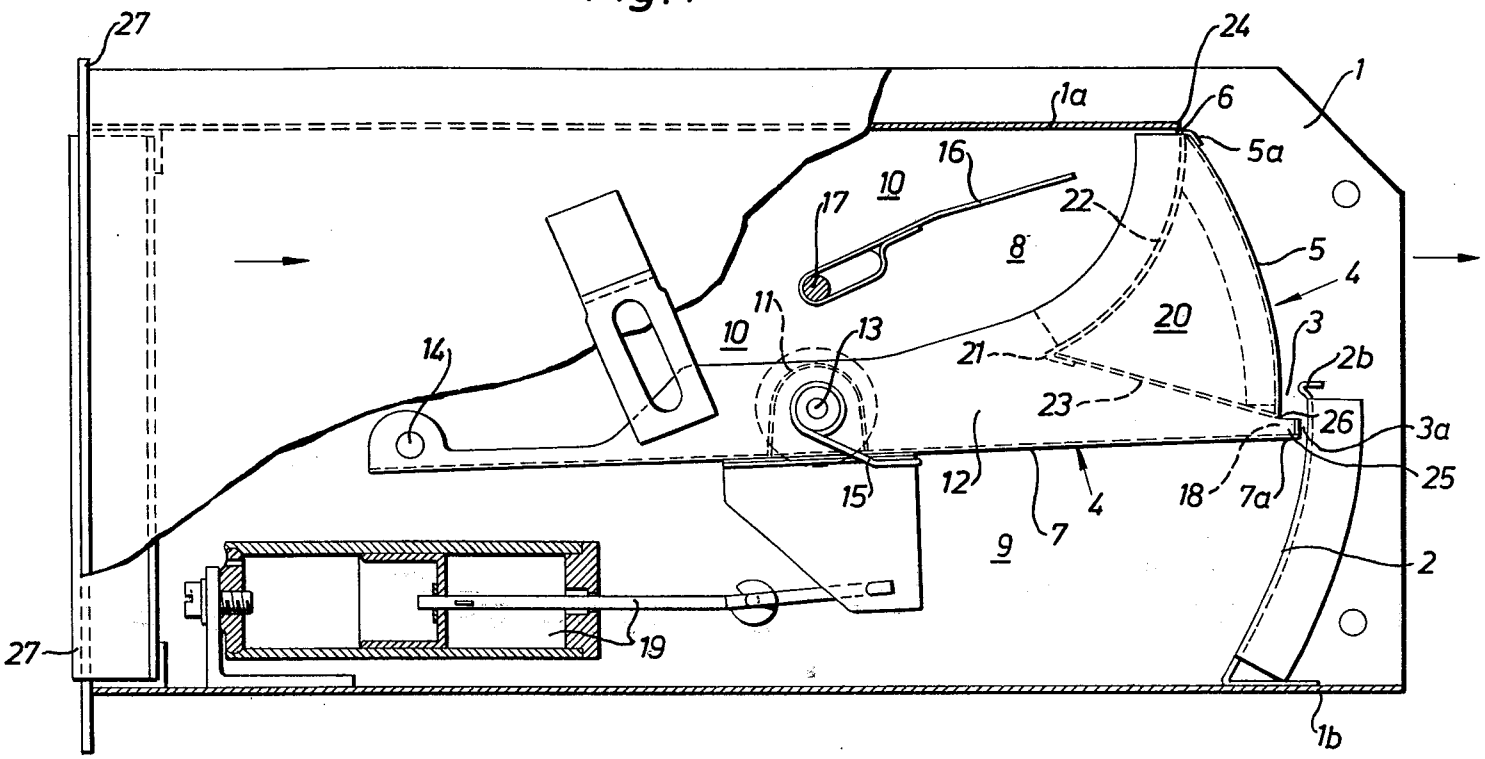

This invention relates to the reduction of disturbing noise in an air flow control device of the type that is adapted to maintain in a ventilation duct an adjustable air flow which is constant independent of the pressure upstream of the control device.

In particular, the invention relates to an improvement over the type of air flow control device disclosed in Swedish Pat. No. 362,490. Such a control device comprises a casing, which preferably constitutes a section of the ventilation duct and includes a plate-like pressure plane as a sensing member and an arc-shaped valve blade as a throttling member for the air flow. The pressure plane and the valve blade are assembled to a structural unit which is rotatably supported in a hub disposed perpendicular to the air flow direction. An arc-shaped stationary baffle or threshold projects from one wall of the casing in parallel with the arc-shaped valve blade in such a way that the hub together with the opposed wall of the casing form a fixed throttling gap for the air flow. The throttling member together with the stationary threshold and the opposed wall of the casing form a variable throttling gap for the air stream, whereas the pressure plane and the valve blade are oriented and connected in such a way that they form an open pocket turned towards the air streaming from the fixed gap to the variable throttling gap in the space above the pressure plane. A flow control device of this type is made with a fixed gap between the pressure plane and the lower edge of the valve blade for the compensation of leakage between said structural unit and the fixed threshold and for the equalization of the pressure on the edge of the valve blade that faces toward the throttling gap, by means of a corresponding pressure on the edge of the valve blade that faces toward the just-mentioned fixed gap.

The present invention is based on the realization that a reduction of disturbing noise due to air turbulence is possible in the practical use of mass-produced flow control devices of the type described above. A device in accordance with the present invention that complies with high demands to reduce the disturbing noise, is characterized by the fact that upstream of the arc-shaped valve blade there is provided a cylinder-sector-shaped, mainly hollow body having an edge which is pointed toward the air flow. The surfaces of the body adjacent the edge with the adjoining surface of the pressure plane and a wall of the casing, respectively, form inlet channels for two partial streams of the air flow. One stream passes to the throttling gap and the other to the gap between the pressure plane and the valve blade. These channels are made so that their sectional areas decrease in order to avoid turbulence and associated disturbing noise in said gaps. A suitable design of the device is characterized by the fact that the sector-shaped body consists of the valve blade, a mainly arcuate concave surface, a mainly flat surface and two side surfaces formed by the two arms or stay members of the moving unit. In a preferred design the mainly flat surface of the sector-shaped body has a dimension *a* along the flow direction, which is calculated to be 0.3–0.4 times the height H of the flow control device, H, (preferably 0.38 H), and the edge of the sector-shaped body is raised from a horizontal plane through the hub a distance *b*, which is 0.1–0.2 times the height of the flow control device, H, (preferably 0.135 H). In addition, the mainly circular concave surface is made with a radius of curvature that is 0.3–0.5 H, (preferably 0.42 H), while the valve blade has such large dimensions that its upper edge line coincides with the ceiling of the casing when the flow control device is closed. Further, the ceiling of the casing has such a length that its front edge line (seen in the flow direction) coincides with the upper edge line of the valve blade when the flow control device is closed.

Figure 2:
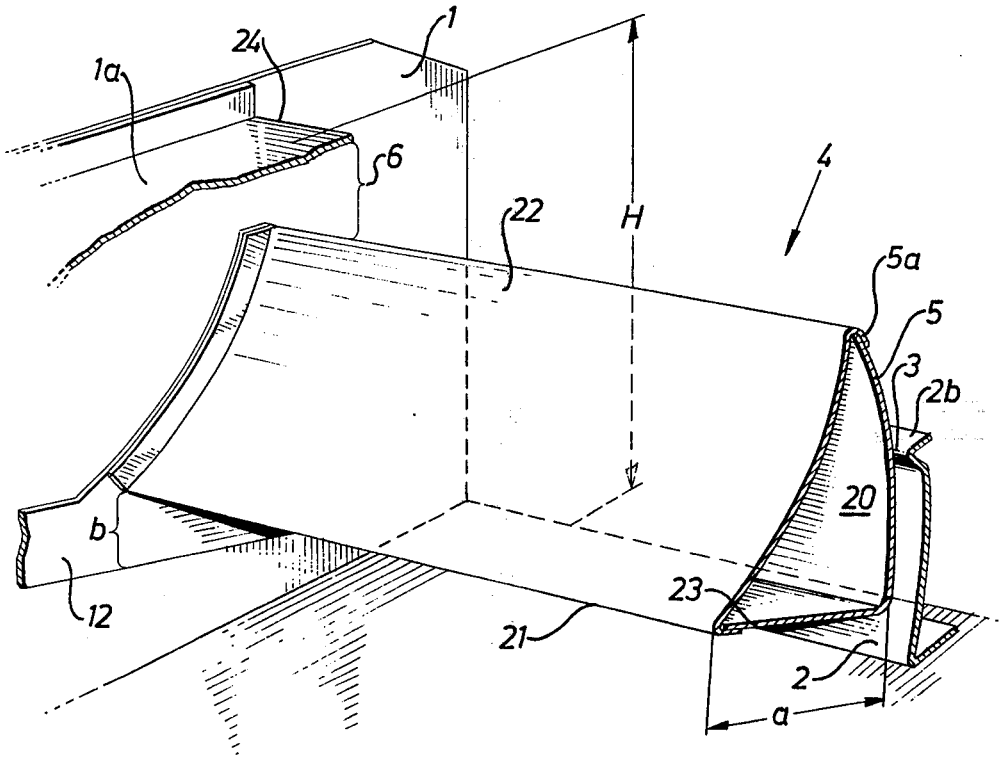

The invention is described in more detail below with reference to the accompanying drawings in which:

FIG. 1 is a longitudinal sectional view of a casing provided with a flow control device embodying the principles of the present invention; and FIG. 2 is a perspective view of the cylinder-sector-shaped body that is an essential part of the flow control device of FIG. 1.

The different movable parts of the flow control device are enclosed in a casing 1. The upper wall of the casing is designated 1*a* and the corresponding lower wall is designated 1*b*. A stationary arc-shaped baffle or threshold 2 projects from the lower wall 1*b*. A structural movable unit 4 comprises a plate-like pressure plane 7 serving as a sensing member and an arc-shaped valve blade 5 serving as a throttling member and spaced a small distance from the arc-shaped threshold 2. The space in front of (upstream of) the arc-shaped valve blade 5 forms a cylinder-sector-shaped, mainly hollow body designated by 20. The body 20 is attached at its ends to arm-like stay members 12 which are mounted to a hub 11 for rotation about an axle 13 which is disposed transversely to the direction of air flow through the casing 1. Preferably the stay members 12 and the pressure plane 7 are manufactured integrally by a single shaping operation carried out on a single metal plate.

In addition to the valve blade 5, the body 20 consists of a mainly circular concave surface 22 and a mainly flat surface 23. Since the hub 11 is placed in the center plane of the casing, there is formed an upper space designated by 8 and a lower space designated by 9. The hub 11 forms together with the upper wall 1*a* of the casing a fixed throttling gap 10, which can be varied by an adjustable damper rotatable about an axis 17. A variable throttling gap 6 is formed between the upper wall 1*a* of the casing and the rear (downstream) limiting surface of the sector-shaped body, i.e., the movable valve blade 5, the upper edge of which is designated by 5*a*. The edge 5*a* is formed by a lip on the surface 22 which is bent over the blade 5, and in the closed position of the flow control device the edge 5*a* bears precisely against the forward edge 24 of the casing wall 1*a*. An edge 21 of the cylinder-sector-shaped body 20 faces in a direction opposite to the direction of air flow.

In order to simplify the manufacture and mounting of the pressure plane 7, the body 20 and the threshold 2 it is preferred, instead of giving the gap between the valve blade 5 and threshold 2 a uniform narrow width, to place the threshold 2 at some distance from the valve blade 5 and to provide the upper edge of the threshold with a fold in the shape of a stiffening belled lip 2*b*. This provides a narrow gap 3 between the valve blade 5 and the upper edge of the stationary threshold 2. In addition the pressure plane 7 is provided with an extension 7*a* in order to provide a corresponding narrow gap 3*a*. A fixed gap 18 is provided between the pressure plane 7 and the lower edge of the valve blade 5, which according to a preferred embodiment has an area of the magnitude three times the area of each of the aforesaid gaps 3 and 3*a* respectively. It has been established that with this arrangement the control device can operate with necessary accuracy at all setting positions of the damper 16. The entirely open and, respectively, entirely closed position of the damper 16 has proved to correspond to a variation of the air amounts, which can be passed through the control device, between about 4:1, at unchanged starting pressure. In the illustrated embodiment the control device is provided with a counterweight 14 and a spring 15, which is wound around the axle 13. The flow control device may be provided with a cushioning means 19 of conventional type, for example a piston operating in a cylinder.

According to a preferred embodiment the flat surface 23 of the sector-shaped body 20 has a dimension *a* along the direction of the air flow which is 0.3–0.4 times the height H of the inlet of the flow control device. The edge 21 of the sector-shaped body 20 is preferably designed to be raised a distance *b*, which is 0.1–0.2 times the height H, above a horizontal plane through the hub 11. According to a preferred embodiment the radius of curvature of the circular, concave surface 22 of the body 20 is 0.3–0.5 H, and the valve blade 5 which defines the rear limiting surface of the sector-shaped body 20 has dimensions such that its upper edge line 5*a* coincides with the corresponding end edge 24 of the upper wall 1*a* of the casing, when the flow control device is totally closed. The mounting of the valve blade 5 in its correct position is facilitated by the fact that the stay means 12 has a corner 26 located at the extension 7*a* and its folded side 25, which is designed to catch the lower edge of the valve blade 5 into the correct position.

The upper edge 5*a* of the valve blade 5 is held rigid by the upper portion of the stays 12, and thereby the body 20 of cylinder-sector shape is held completely and accurately in relation to the pressure plane 7 and its lateral stays 12. This has been shown to be important for being able to meet the reproducibility requirement of the flow control device with good accuracy at the series production of the elements comprised therein. This design also ensures that the edge 7*a* is straight and rigid. The forward edge of the upper wall of the casing, that is the wall 1*a*, must not project beyond the edge 5*a* of the valve blade in the direction of the flow, if disturbing noise production is to be prevented. When the edge 24 of the wall 1*a* projects beyond the upper edge 5*a* of the valve blade, it was found that at decreasing width of gap 6 — due to pressure increase before the control device and resulting elevation of the pressure plane 7 in order to keep the flow constant — the edge 24 of the roof 1*a* will be subjected to an ever increasing blow of the air stream through the gap 6, with resulting heavy increase of noise production.

The stay means 12 and their extended parts 25 are, according to a preferred construction, positioned at such a distance from the sides of the casing 1 that a gap of 0.5–5 mm (preferably in the range of H/100 mm, where H designates the said height of the flow control device) is provided between these sides and the body 20 supporting the movable unit 4.

The mode of operation of a flow control device of the above-mentioned type is as follows: The casing 1 is assumed to be positioned within or be connected to a ventilation duct by flanges 27. The air in the casing flows in the direction of the arrows. The air flow passes through the inlet in the fixed throttling gap 10 to the space 8 and leaves via the outlet in a variable throttling gap 6 to the subsequent part of the ventilation duct. The arrangement in the inlet 10 produces a static vacuum in the space 8 in relation to the space 9. Above the pressure plane 7, thus, a pressure difference arises, which produces a moment on the unit 4 about the axis 13 tending to close the gap 6 with the valve blade 5. The unit 4, i.e., the pressure plane 7 and the body 20 with the valve blade 5, on the other hand, produces by its weight a moment in the opposite direction. The unit 4 therefore assumes a position in which the two opposed moments neutralize each other. If the air flow tends to be changed by a pressure variation in the ventilation duct upstream or downstream of the flow control device, this change would affect the air rate above the inlet 10. This results, as described above, immediately in a new closing moment, which moves the pressure plane 7 and the body 20 with the valve blade 5 to a new position, where the two moments again compensate each other and thereby reestablish the rate above the inlet 10. By maintaining the air rate in the nonvariable inlet 10 constant, thus, the air flow through the air flow control device remains constant.

It will be seen from the drawings that the edge 21 of the body 20 divides the air flow into two partial streams flowing to the gaps 18 and 6, respectively, through channels the cross sectional areas of which gradually decrease. This arrangement is very important in avoiding turbulence and associated noise in the gaps 18 and 6.

What is claimed is:

1. In a casing having walls defining an air passage a flow control assembly of the type including a baffle or threshold projecting into the air passage from one wall of said casing toward an opposed wall of said casing, said threshold having an arcuate concave surface facing upstream, a plate or pressure plane disposed upstream of said threshold and mounted for rotation about an axis transverse to the axis of the casing such that its downstream end moves parallel to said arcuate face of said threshold, an arcuate valve blade carried at the downstream end of said pressure plane for forming an adjustable throttling gap between said threshold and said opposed wall of said casing, there being a fixed gap between said valve blade and said pressure plane, the improvement comprising air guiding means disposed upstream of said arcuate valve blade forming separate first and second channels leading to said adjustable throttling gap and to said fixed gap, respectively, said channels having cross sectional areas which decrease in the direction of air flow whereby air turbulence and associated noise in said gaps are reduced.

2. Apparatus as in claim 1 wherein said air guiding means includes two surfaces diverging in a downstream direction from a common edge which extends transversely of the air passage whereby the first channel is formed in part by one of said diverging surfaces and said one wall of said casing and whereby the second channel is formed in part by the other diverging surface and said opposed wall of said casing.

3. Apparatus as in claim 1 wherein said air guiding means includes a hollow body having an axis extending transversely to said air passage, said body comprising said arcuate valve blade as one of its walls and comprising two side surfaces diverging in a downstream direction from a common edge which extends transversely to said air passage.

4. Apparatus as in claim 3 wherein said hollow body is provided with two end surfaces extending upstream of said two side surfaces.

5. In a casing having walls defining an air passage a flow control assembly of the type including a baffle or threshold projecting into the air passage from a wall of said casing toward an opposed wall of said casing, said threshold having an arcuate surface facing upstream, a plate or pressure plane disposed upstream of said threshold and mounted for rotation such that its downstream end moves parallel to said arcuate face of said threshold, an arcuate valve blade carried at the downstream end of said pressure plane for forming an adjustable throttling gap between said threshold and said opposed wall of said casing, there being a fixed gap between said valve blade and said pressure plane, the improvement comprising air guiding means disposed upstream of said arcuate valve blade said air guiding means including a hollow body having an axis extending transversely to said air passage, said body comprising said arcuate valve blade as one of its walls and comprising two side surfaces diverging in a downstream direction from a common edge which extends transversely to said air passage, one side surface of said body facing said opposed wall of said casing and being concave and the other side surface of said body facing said pressure plane and being generally flat, said body forming separate channels leading to said adjustable throttling gap and to said fixed gap, respectively, said channels having cross sectional areas which decrease in the direction of air flow whereby air turbulence and associated noise in said gaps are reduced.

6. Apparatus as in claim 5 wherein said generally flat surface has a dimension along the air flow direction which is about 0.3 to 0.4 times the dimension between said walls of said casing, wherein said edge formed by said body is disposed a distance above the axis of rotation of said pressure plane which is about 0.1 to 0.2 times said dimension between casing walls and wherein said concave side wall of said body has a radius of curvature which is about 0.3 to 0.5 times said dimension between said casing walls.

7. Apparatus as in claim 5 wherein said opposed wall of said casing terminates in an edge which faces downstream and wherein said arcuate valve member has a free edge which engages said just mentioned edge in a closed position of said flow control assembly.

* * * * *